US006501224B2

(12) United States Patent
Miki et al.

(10) Patent No.: US 6,501,224 B2
(45) Date of Patent: Dec. 31, 2002

(54) MAGNETRON HAVING MAGNETIC POLE PIECES PROVIDING A SPECIFIC MAGNETIC FLUX TO THICKNESS RATIO

(75) Inventors: Kazuki Miki, Himeji (JP); Setsuo Hasegawa, Kasai (JP); Satoshi Nakai, Kasai (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 21 days.

(21) Appl. No.: 09/738,315

(22) Filed: Dec. 18, 2000

(65) Prior Publication Data

US 2001/0004192 A1 Jun. 21, 2001

(30) Foreign Application Priority Data

Dec. 20, 1999 (JP) ..... 11-360795
Nov. 14, 2000 (JP) ..... 2000-346586

(51) Int. Cl.[7] ..... H01J 25/02
(52) U.S. Cl. ..... 315/39.71; 315/39.51
(58) Field of Search ..... 315/39.71, 39.51

(56) References Cited

U.S. PATENT DOCUMENTS 4,772,823 A * 9/1988 Matsuzaki et al. ..... 315/39.51
5,357,168 A 10/1994 See ..... 315/39.51
5,635,798 A 6/1997 Ogura et al. ..... 315/39.71

FOREIGN PATENT DOCUMENTS

JP 2000-299070 10/2000

OTHER PUBLICATIONS

European Search Report for EP 00127801 dated May 14, 2001.
Patent Abstracts of Japan: 03011526 (Jan. 18, 1991), 05041173 (Feb. 19, 1993), and 62113336 (May 25, 1987).

* cited by examiner

*Primary Examiner*—Benny T. Lee
(74) *Attorney, Agent, or Firm*—Sughrue Mion, PLLC

(57) ABSTRACT

A magnetron comprising an anode portion, a cathode portion provided in a center of the anode portion, a cylindrical interaction space formed of the anode portion and the cathode portion, and iron magnetic pole pieces located at both ends of the interaction space in an tube axis direction thereof. A relationship between a thickness Tg (mm) of a tapered portion of the magnetic pole pieces and a magnetic flux Bg (mT, at 25° C.) of a center of the interaction space is set to satisfy 155<Bg/Tg<165. It is possible to obtain a magnetron with substantially constant oscillating efficiencies, and it is accordingly possible to stabilize outputs of the microwave oven and to enable easy control of heating food.

2 Claims, 3 Drawing Sheets

MAGNETRON HAVING MAGNETIC POLE PIECES PROVIDING A SPECIFIC MAGNETIC FLUX TO THICKNESS RATIO

BACKGROUND OF THE INVENTION

The present invention relates to a magnetron used in microwave heating apparatuses such as microwave ovens or in radars.

FIG. 1 is a half sectional view of a magnetron which has been conventionally employed. Numeral 1 denotes an anode shell which is made of oxygen-free steel or the like and which forms a part of a vacuum wall (wall surface of a vacuum vessel) wherein a plurality of vanes 2 are provided at an inner periphery thereof to extend towards the center in a radial manner with every second vane 2 being connected by strap rings 7, 8 of small-diameter and large-diameter for achieving stabilization of π mode oscillation. Magnetic pole pieces 9, 10, which are also referred to as pole pieces, are respectively provided on both ends of the anode shell 1 for focusing a magnetic field in an interaction space formed between tip ends of the vanes 2 and a filament 3 which is axially provided in a central portion of the anode shell 1 to thus form anode portions.

The filament 3 is a filament obtained by winding, for instance, a thorium tungsten wire in a coil-like manner, and is provided at the central portion of the anode shell 1 in a space which is enclosed by the tip ends of the respective vanes 2 to form a cathode portion. End hats 4, 5 for supporting the filament 3 are fixedly attached to both ends thereof. Numeral 6 denotes an antenna conductor connected to one of the vanes 2, and the magnetic pole piece 9 is provided with a hole through which the antenna conductor 6 is pierced.

Numeral 11 denotes a top shell, which is a sealing metal, fixedly attached to the anode shell for pinching the magnetic pole piece 9, numeral 12 denotes a stem metal, which is a sealing metal, fixedly attached to the anode shell 1 for pinching the magnetic pole piece 10, the magnetic pole pieces 9, 10 having a tapered portion having a thickness Tg, numeral 13 denotes an antenna ceramic fixedly attached to the top shell 11 through brazing for supporting an output portion, numeral 14 denotes an output pipe fixedly attached to the antenna ceramic 13 and further connected to the antenna conductor 6, numeral 15 denotes an antenna cap which is press-fitted into the output pipe 14, and numeral 16 denotes a stem ceramic fixedly attached to the stem metal 12 for supporting the end hats 4, 5.

The above members constitute a vacuum tube, while numerals 17, 18 denote annular magnets which are respectively disposed above and below the anode shell 1, numeral 19 denotes a cooling fin fitted and attached to an outer peripheral surface of the anode shell 1, and numeral 20 denotes a yoke for enclosing the anode shell 1, the magnets 17, 18 and the cooling fin 19. Numeral 21 further denotes a shielding case for enclosing the stem ceramic 16 projecting out from the yoke 20 and for housing therein a choke 22 and a feedthrough capacitor 23 which constitute a filter circuit.

Numeral 24 denotes a gasket which is in close contact with a joint portion of the microwave oven, and numeral 25 denotes a gasket ring press-fitted into the top shell 11 for holding the gasket 24. In such an arrangement, a cylindrical space formed between the filament 3 and the vanes 2 is called an interaction space wherein thermoelectrons emitted from the filament 3 perform orbiting movements within the interaction space through magnetic force applied in a vertical direction with respect to an electric field to thereby generate microwaves of high-frequency energy. Microwaves which are generated at the anode portion will be transmitted through the antenna conductor 6 and emitted to the exterior from a surface of the antenna cap 15.

However, a conventional magnetron is designed to prevent magnetic saturation of a magnetic circuit, and since the magnetron attached to a microwave oven will increase in magnetic temperature accompanying an increase in operational time, a central magnetic flux density of the interaction space will be decreased accordingly accompanying the operational time. Thus, oscillating efficiencies would fluctuate to cause unstableness in heating control of food within the microwave oven.

The present invention thus aims to provide a magnetron capable of restricting decreases in magnetic flux density, that is, decreases in oscillating efficiencies owing to increases in magnetic temperature of the magnetron accompanying operation of the microwave oven and capable of achieving substantially constant oscillating efficiencies.

SUMMARY OF THE INVENTION

In accordance with a first aspect of the present invention, there is provided a magnetron comprising an anode portion, a cathode portion provided in a center of the anode portion, a cylindrical interaction space formed of the anode portion and the cathode portion, and iron magnetic pole pieces located at both ends of the interaction space in an tube axis direction thereof, wherein a relationship between a thickness Tg (mm) of a tapered portion of the magnetic pole pieces and a magnetic flux Bg (mT, at 25° C.) of a center of the interaction space is set to satisfy $155<Bg/Tg<165$.

In accordance with a second aspect of the present invention, there is provided a magnetron comprising an anode portion, a cathode portion provided in a center of the anode portion, a cylindrical interaction space formed of the anode portion and the cathode portion, and iron magnetic pole pieces located at both ends of the interaction space in an tube axis direction thereof, wherein an outer diameter of the interaction space is not more than a diameter of a central hole of the magnetic pole pieces and wherein a relationship between a thickness Tg (mm) of a tapered portion of the magnetic pole pieces and a magnetic flux Bg (mT, at 25° C.) of a center of the interaction space is set to satisfy $155<Bg/Tg<165$.

With this arrangement, it is possible to restrict decreases in magnetic flux density, that is, decreases in oscillating efficiencies due to increases in magnetic temperature of the magnetron accompanying operation of the microwave oven and it is thus possible to obtain a magnetron with substantially constant oscillating efficiencies.

DETAILED DESCRIPTION OF THE INVENTION

An embodiment of the present invention will be explained hereinafter. The basic arrangement of the magnetron according to the present invention is similar to that of FIG. 1 while the present invention is characterized by its dimensional arrangement for the magnetic pole pieces and such magnetic pole pieces are applied to the magnetron of FIG. 1. Since the overall arrangement of FIG. 1, which embodies the basic arrangement, has already been described, further explanations thereof will be omitted here.

The present invention has been made in view of the fact which has become obvious through studies of the present inventors, namely that an increase in magnetic flux density and an increase in oscillation efficiency are proportional to each other in case a magnetic circuit of the magnetron is not in a saturated condition, while the oscillation efficiency becomes constant without being affected through increases or decreases in the magnetic flux density near a saturated condition.

Figure 1:
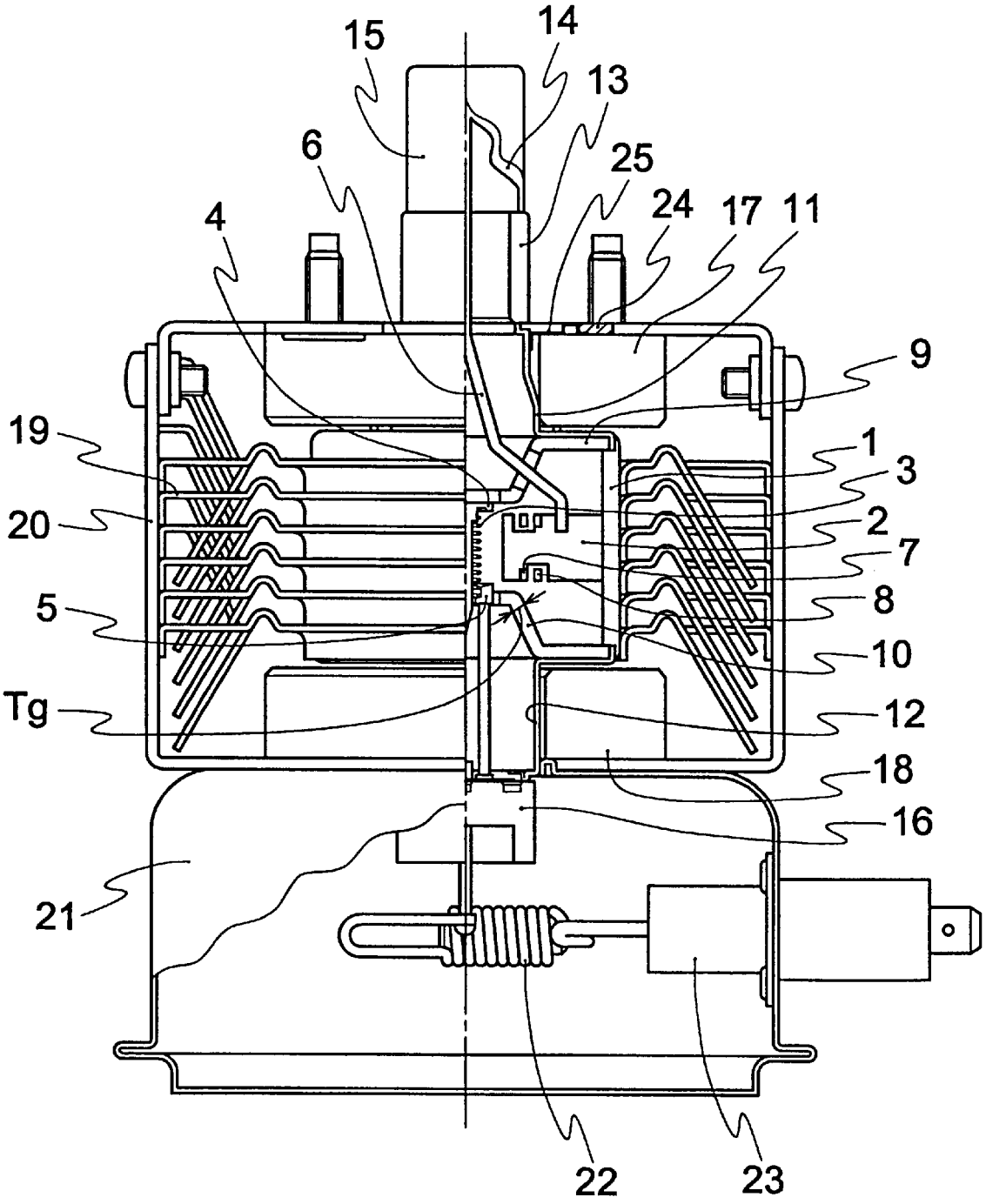
FIG. 1 PRIOR ART
FIG. 1 is a half sectional view of a conventional magnetron.

More particularly as depicted in FIG. 1, it was the case with conventional magnetrons that microwaves were generated in a space formed between the filament 3 and 10 pieces of vanes 2 which were transmitted from the vanes 2 through the antenna conductor 6 to be emitted into space by the antenna cap 15.

Figure 2:
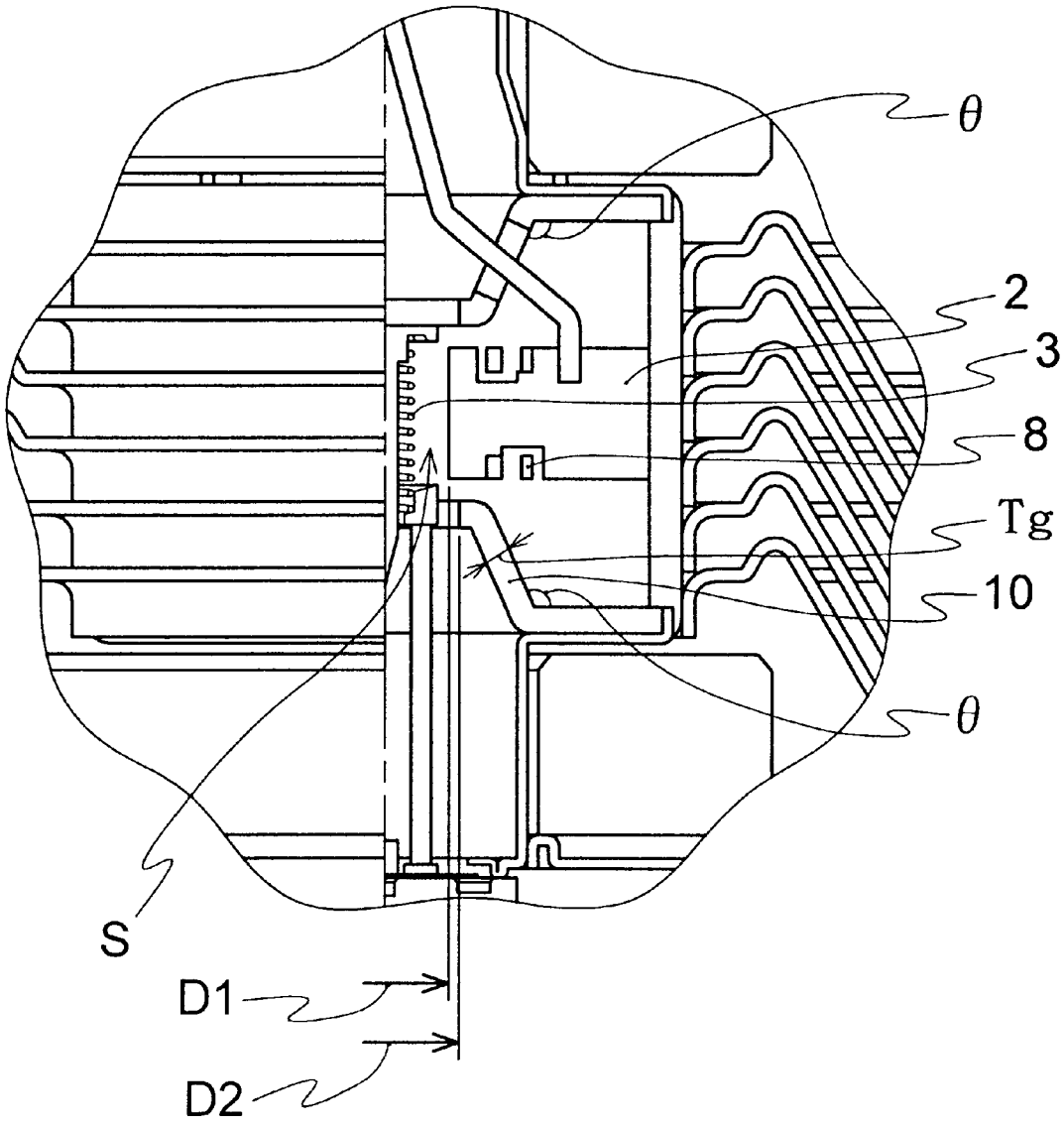
FIG. 2 is a partially enlarged view of the magnetron.
Figure 3:
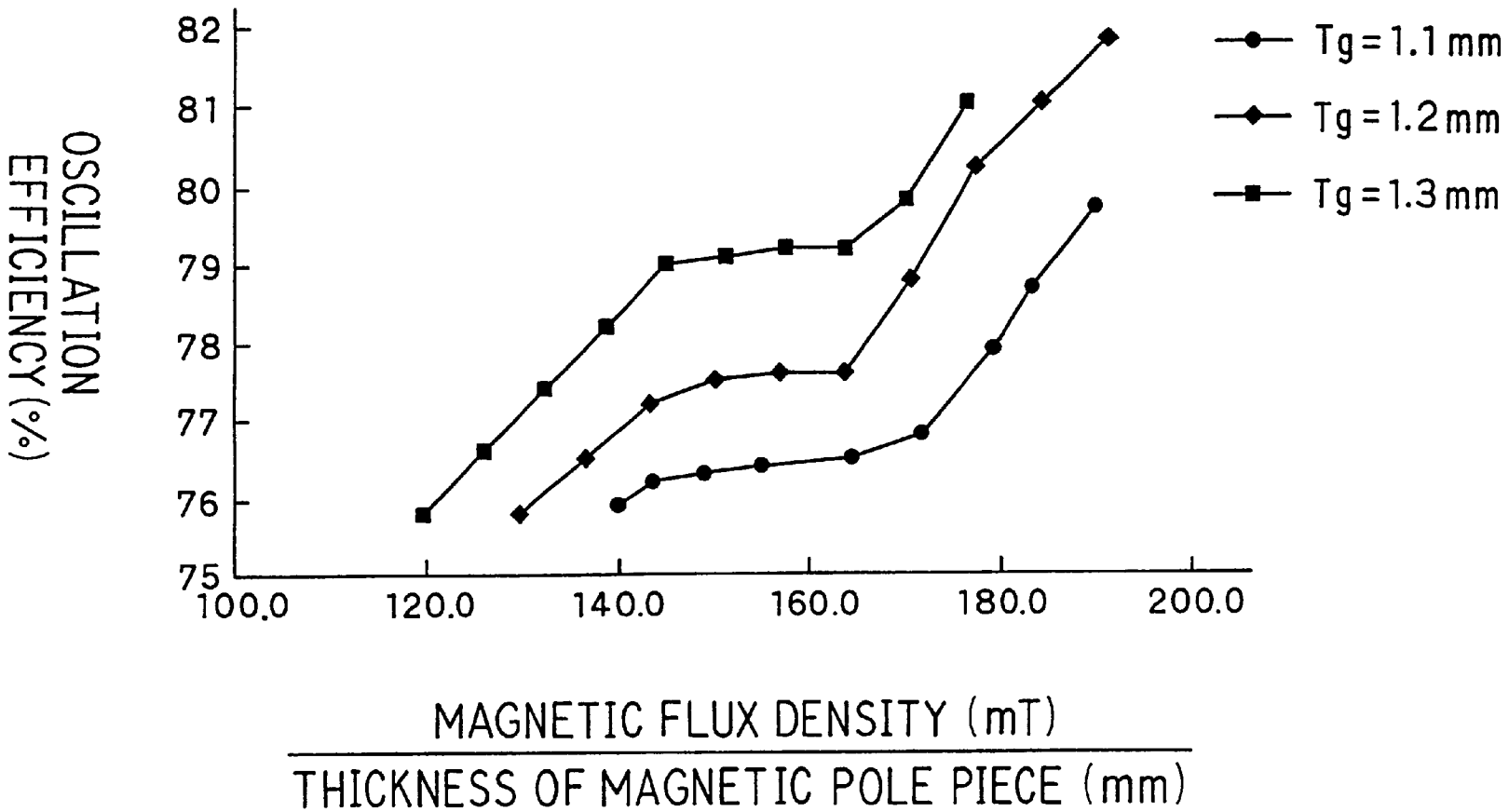
FIG. 3 is a characteristic view of the magnetron according to the present invention.

FIG. 2 is an enlarged view of the interaction space portion of the magnetron for microwave ovens having a fundamental frequency for oscillation of 2450 MHZ and an output of an order of 900 W. The oscillation efficiency in case the thickness Tg of the tapered portion of the magnetic pole pieces (which is inclined by about 116° (refer to angle θ in FIG. 2) towards the interaction space S with respect to the outer peripheral horizontal surface fixedly attached to the anode shell 1 is set to 1.1 mm, 1.2 mm or 1.3 mm, and the magnetic flux density of the center of the interaction space is varied in the range from 160 mT to 210 mT is illustrated in FIG. 3. Changes in the magnetic flux density are performed by adjusting electric powder for magnetizing and components such as magnets are identical in all of these cases. Further, in the measurement in FIG. 3, a.c. voltage of 3.3 V is applied to the filament 3 to make the filament 3 thermally stable, anode voltage is then applied also to the anode portion, and the anode voltage and anode current are adjusted to make input to the magnetron a constant value of 1200 W. Outputs when a ratio of load to standing wave is less than 1.1 are measured As shown in FIG. 2, the outer diameter D1 of the interaction spaces is not more than the outer diameter D2 of the central hole of the magnetic pole pieces.

As it is evident from FIG. 3, the oscillation efficiency increases proportional to the increase in magnetic flux density in case the magnetic flux density is low prior to magnetic saturation of the magnetic pole pieces. In proximity of magnetic saturation of the magnetic pole pieces, the oscillation efficiency becomes substantially constant. This is considered to be due to the fact that the magnetic flux which focuses at the central portion of the magnetic pole pieces is relatively decreased through the magnetic saturation to thereby change a distribution of the magnetic flux density of the interaction space. Such a change becomes remarkably apparent in case an inner diameter of the anode is smaller than the diameter of the central hole of the magnetic pole pieces. After complete magnetic saturation of the magnetic pole pieces, the oscillation efficiency increases proportional to the increase in magnetic flux density.

A leakage transformer as employed in a microwave oven functions to maintain input power constant by increasing a current to cope with decreases in anode voltage caused through the decrease in magnetic flux density of the center of the interaction space owing to the increase in magnetic temperature. By combining this action and the act that the oscillation efficiency comes to a constant condition when proximate to magnetic saturation of the magnetic pole pieces, it is possible to maintain the oscillation efficiency constant irrespective of changes in magnetic temperature.

The expression "proximate to magnetic saturation of the magnetic pole pieces" means that a value obtained by dividing the magnetic flux density Bg (mT) of the center of the interaction space by the thickness Tg (mm) of the tapered portion of the magnetic pole pieces is larger than 155 and smaller than 165. More particularly, by setting the relationship between the thickness Tg (mm) of the tapered portion of the magnetic pole pieces and the magnetic flux Bg (mT, at 25° C.) of a center of the interaction space to satisfy $155<Bg/Tg<165$, the oscillation efficiency can be stabilized without being largely affected by changes in Bg.

As explained so far, the magnetron according to the present invention is capable of restricting decreases in magnetic flux density, that is, decreases in oscillating efficiencies owing to increases in magnetic temperature of the magnetron accompanying operation of the microwave oven to thereby obtain a magnetron with substantially constant oscillating efficiencies, and it is accordingly possible to stabilize outputs of the microwave oven and to enable easy control of heating food.

What is claimed is:

1. A magnetron comprising a hollow anode portion, a cathode portion provided in a center of the anode portion, a cylindrical interaction space disposed between the anode portion and the cathode portion, and iron magnetic pole pieces located at both ends of the interaction space in a tube axis direction thereof, wherein a relationship between a thickness Tg (mm) of a tapered portion of the magnetic pole pieces and a magnetic flux Bg (mT, at 25° C.) of a center of the interaction space is set to satisfy $155<Bg/Tg<165$.

2. A magnetron comprising a hollow anode portion, a cathode portion provided in a center of the anode portion, a cylindrical interaction space disposed between the anode portion and the cathode portion, and iron magnetic pole pieces located at both ends of the interaction space in a tube axis direction thereof, wherein an outer diameter of the interaction space is not more than a diameter of a central hole of the magnetic pole pieces and wherein a relationship between a thickness Tg (mm) of a tapered portion of the magnetic pole pieces and a magnetic flux Bg (mT, at 25° C.) of a center of the interaction space is set to satisfy $155<Bg/Tg<165$.

* * * * *